US007193590B2

(12) United States Patent
Ishizuka et al.

(10) Patent No.: US 7,193,590 B2
(45) Date of Patent: Mar. 20, 2007

(54) APPARATUS AND METHOD FOR DRIVING DISPLAY PANEL

(75) Inventors: Shinichi Ishizuka, Tsurugashima (JP); Tsuyoshi Sakamoto, Tsurugashima (JP); Hideo Ochi, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/863,353

(22) Filed: Jun. 9, 2004

(65) Prior Publication Data

US 2004/0223008 A1 Nov. 11, 2004

Related U.S. Application Data

(63) Continuation of application No. 09/985,152, filed on Nov. 1, 2001, now Pat. No. 6,771,235.

(30) Foreign Application Priority Data

Nov. 1, 2000 (JP) ..... 2000-334596

(51) Int. Cl.
*G09G 3/30* (2006.01)
*G09G 3/10* (2006.01)

(52) U.S. Cl. ..... 345/76; 345/82; 345/690; 315/169.1; 315/169.3

(58) Field of Classification Search ..... 345/44–46, 345/76–78, 82, 204, 690, 691; 315/169.1, 315/169

See application file for complete search history.

(56) References Cited

U.S. PATENT DOCUMENTS 5,844,368 A 12/1998 Okuda et al.
5,856,813 A 1/1999 Katayama et al.
6,121,943 A 9/2000 Nishioka et al.
6,201,520 B1 * 3/2001 Iketsu et al. ..... 345/76
6,222,323 B1 4/2001 Yamashita et al.
6,271,812 B1 8/2001 Osada et al.
6,310,589 B1 10/2001 Nishigaki et al.
6,339,415 B2 1/2002 Ishizuka
6,366,026 B1 4/2002 Saito et al.
6,369,786 B1 * 4/2002 Suzuki ..... 345/77
6,376,994 B1 4/2002 Ochi et al.
6,473,064 B1 10/2002 Tsuchida et al.
6,587,087 B1 7/2003 Ishizuka
6,621,228 B2 * 9/2003 Harada et al. ..... 315/169.3
6,707,438 B1 3/2004 Ishizuka et al.
2001/0028334 A1 * 10/2001 Ishizuka ..... 345/76

* cited by examiner

*Primary Examiner*—Henry N. Tran
(74) *Attorney, Agent, or Firm*—Sughrue Mion, PLLC

(57) ABSTRACT

An apparatus for driving a display panel having drive lines and capacitive light emitting elements. The apparatus sequentially selects one scanning line from the scanning lines every scanning period of input video data including a gradation level to specify a drive line corresponding to at least one capacitive light emitting element driven to emit light on the one scanning line in accordance with the input video data, generates a driving signal having a pulse width in accordance with the gradation level every scanning period, and applies the one capacitive light emitting element with a voltage equal to or higher than a light emission threshold voltage in a forward direction for a duration in which the driving signal is generated, through the one scanning line and the specified drive line, and applies the specified drive line with a predetermined potential in response to elimination of the driving signal to decrease the voltage applied to the one capacitive light emitting element in the forward direction to a voltage lower than the light emission threshold voltage.

6 Claims, 12 Drawing Sheets

APPARATUS AND METHOD FOR DRIVING DISPLAY PANEL

This is a continuation of application Ser. No. 09/985,152 filed Nov. 1, 2001 now U.S. Pat. No. 6,771,235; the disclosure of which is incorporated herein by reference.

BACKGROUND OF THE INVENTION

1. Field of the Invention

The present invention relates to an apparatus and method for driving a light emitting panel using capacitive light emitting elements such as organic electroluminescence elements.

2. Description of the Related Background Art

In recent years, with the trend of increasing the size of display devices, thinner display devices have been required, and a variety of thin display devices have been brought into practical use. An electroluminescence display composed of a plurality of organic electroluminescence elements arranged in a matrix has drawn attention as one of the thin display devices.

The organic electroluminescence element (hereinafter simply called the "EL element") may be electrically represented as an equivalent circuit as illustrated in FIG. 1. As can be seen from FIG. 1, the element can be replaced with a circuit configuration composed of a capacitive component C and a component E of a diode characteristic coupled in parallel with the capacitive component C. Thus, the EL element can be regarded as a capacitive light-emitting element. As the EL element is applied with a direct current light-emission driving voltage across the electrodes, a charge is accumulated in the capacitive element C. Subsequently, when the applied voltage exceeds a barrier voltage or a light emission threshold voltage inherent to the element, a current begins flowing from one electrode (on the anode side of the diode component E) to the organic functional layer which is a light emitting layer so that light is emitted therefrom at an intensity proportional to this current.

The Voltage V—Current I—Luminance L characteristic of the element is similar to the characteristic of a diode, as illustrated in FIG. 2. Specifically, the current I is extremely small at a light emission threshold voltage Vth or lower, and abruptly increases as the voltage increases to the light emission threshold voltage Vth or higher. The current is substantially proportional to the luminance L. Such an element, when applied with a driving voltage exceeding the light emission threshold voltage Vth, exhibits a light emission luminance in proportion to a current corresponding to the applied driving voltage. On the other hand, the light emission luminance remains equal to zero when the driving voltage applied to the element is at the light emission threshold voltage Vth or lower which does not cause the driving current to flow into the light emitting layer.

As a method of driving a display panel using a plurality of EL elements as described above, a simple matrix driving mode is known. FIG. 3 illustrates an exemplary structure of a driver in accordance with the simple matrix driving mode. In a light emitting panel, n cathode lines (metal electrodes) $B_1$–$B_n$ are arranged extending in parallel in the horizontal direction, and m anode lines (transparent electrodes) $A_1$–$A_m$ are arranged extending in parallel in the vertical direction. At each of intersections of the cathode lines and the anode lines (a total of n×m locations), an EL element $E_{1,1}$–$E_{m,n}$ is formed. The elements $E_{1,1}$–$E_{m,n}$ which carry pixels are arranged in matrix, each have one end connected to an anode line (on the anode line side of the diode component E in the aforementioned equivalent circuit) and the other end connected to a cathode line (on the cathode line side of the diode component E in the aforementioned equivalent circuit) corresponding to the intersections of the anode lines $A_1$–$A_m$ along the vertical direction and the cathode lines $B_1$–$B_n$ along the horizontal direction. The cathode lines are connected to a cathode line scanning circuit 1, while the anode lines are connected to an anode line drive circuit 2.

The cathode line scanning circuit 1 has scanning switches $\mathbf{5}_1$–$\mathbf{5}_n$ corresponding to the cathode lines $B_1$–$B_n$ for individually determining potentials thereon. Each of the scanning switches $\mathbf{5}_1$–$\mathbf{5}_n$ supplies a corresponding cathode line either with a bias potential Vcc (for example, 20 volts) or with a ground potential (zero volt).

The anode line drive circuit 2 has current sources $\mathbf{2}_1$–$\mathbf{2}_m$ (for example, regulated current sources) corresponding to the anode lines $A_1$–$A_m$ for individually supplying the EL elements with driving currents through respective anode lines, and drive switches $\mathbf{6}_1$–$\mathbf{6}_n$Each of the drive switches $\mathbf{6}_1$–$\mathbf{6}_n$ is adapted to supply an associated anode line with the output of the current source $\mathbf{2}_1$–$\mathbf{2}_m$ or a ground potential. The current sources $\mathbf{2}_1$–$\mathbf{2}_m$ supply the associated elements with such amounts of currents that are required to maintain the respective EL elements to emit light at desired instantaneous luminance (hereinafter this state is called the "steady light emitting state"). Also, When an EL element is in the steady light emitting state, the aforementioned capacitive component C of the EL element is charged with a charge, so that the voltage across both terminals of the EL element is at a positive value $V_F$ (hereinafter, this value is called the "forward voltage") slightly higher than a light emitting threshold voltage Vth. It should be noted that when voltage sources are used as driving sources, their driving voltages are set to be equal to $V_F$.

The cathode line scanning circuit 1 and the anode line drive circuit 2 are connected to a light emission control circuit 4.

The light emission control circuit 4 controls the cathode line scanning circuit 1 and the anode line drive circuit 2 in accordance to the image data supplied from an image data generating system, not shown, so as to display an image represented by the image data. The light emission control circuit 4 generates a scanning line selection control signal for controlling the cathode line scanning circuit 1 to switch the scanning switch $\mathbf{5}_1$–$\mathbf{5}_n$ such that any of the cathode lines corresponding to a horizontal scanning period of the image data is selected and set at the ground potential, and the remaining cathode lines are applied with the bias potential Vcc. The bias potential Vcc is applied by regulated voltage sources connected to cathode lines in order to prevent crosstalk light emission from occurring in EL elements connected to intersections of a driven anode line and cathode lines which are not selected for scanning. The bias potential Vcc is typically set equal to the light emission regulating voltage $V_F$ ($Vcc=V_F$). As the scanning switches $\mathbf{5}_1$–$\mathbf{5}_n$ are sequentially switched to the ground potential in each horizontal scanning period, a cathode line set at the ground potential functions as a scanning line which enables the EL elements connected thereto to emit light.

The anode line drive circuit 2 conducts a light emission control for the scanning lines as mentioned above. The light emission control circuit 4 generates a drive control signal (driving pulse) in accordance with pixel information indicated by image data to instruct which of EL elements connected to associated scanning lines are driven to emit light at which timing and for approximately how long, and supplies the drive control signal to the anode line drive circuit 2. The anode line drive circuit 2, responsive to this drive control signal, individually controls the switching of the drive switches $\mathbf{6}_1$–$\mathbf{6}_m$ to supply driving currents to associated EL elements through the anode lines $A_1$–$A_m$ in accordance with the pixel information. In this way, the EL elements supplied with the driving currents are forced to emit light in accordance with the pixel information.

Next, the light emitting operation will be explaining with reference to an example illustrated in FIGS. 3 and 4. This light emitting operation is taken as an example in which a cathode line $B_1$ is scanned to have EL elements $E_{1,1}$ and $E_{2,1}$ emit light, and subsequently, a cathode line $B_2$ is scanned to have EL elements $E_{2,2}$ and $E_{3,2}$ emit light. Also, for facilitating the understanding of the explanation, in FIGS. 3 and 4, an EL element which is emitting light is represented by a diode symbol, while an element which is not emitting light is represented by a capacitor symbol.

Referring first to FIG. 3, only a scanning switch $\mathbf{5}_1$ is switched to the ground potential equal to zero volt to scan a cathode line $B_1$. The remaining cathode lines $B_2$–$B_n$ are applied with the bias potential Vcc through the scanning switches $\mathbf{5}_2$–$\mathbf{5}_n$ Simultaneously, anode lines $A_1$ and $A_2$ are connected to current sources $\mathbf{2}_1$ and $\mathbf{2}_2$ through drive switches $\mathbf{6}_1$ and $\mathbf{6}_2$, respectively. The remaining anode lines $A_3$–$A_m$ are switched to the ground potential equal to zero volt through drive switch $\mathbf{6}_3$–$\mathbf{6}_m$ Thus, in this event, only the EL elements $E_{1,1}$ and $E_{2,1}$ are forward biased so that driving currents flow thereinto from the current sources $\mathbf{2}_1$ and $\mathbf{2}_2$ as indicated by arrows, causing only the EL elements $E_{1,1}$ and $E_{2,1}$ to emit light. In this state, the EL elements $E_{3,2}$ and $E_{m,n}$ which are not emitting light, indicated by hatching, are charged with polarities as indicated in the drawing.

From the light emitting state illustrated in FIG. 3, only the scanning switch $\mathbf{5}_2$ corresponding to the cathode line $B_2$ is now switched to the ground potential equal to zero volt to scan the cathode line $B_2$ as illustrated in FIG. 4. Simultaneously with this scanning, the current sources $\mathbf{2}_2$, $\mathbf{2}_3$ are connected to the corresponding anode lines $A_2$, $A_3$ through the drive switches $\mathbf{6}_2$, $\mathbf{6}_3$ while the remaining anode lines $A_1$, $A_4$–$A_m$ are applied with zero volt through the drive switches $\mathbf{6}_1$, $\mathbf{6}_4$–$\mathbf{6}_m$ respectively. Thus, in this event, only the EL elements $E_{2,2}$, $E_{3,2}$ are forward biased, so that driving currents flow into the EL elements $E_{2,2}$, $E_{3,2}$ from the current sources $\mathbf{2}_2$, $\mathbf{2}_3$ as indicated by arrows, causing only the EL elements $E_{2,2}$, $E_{3,2}$ to emit light.

As described above, the light emitting control is made up of repetitions of a scanning mode that is a period in which any of the cathode lines $B_1$–$B_n$ is activated. The scanning mode is performed every one horizontal scanning period (1H) of image data, wherein the scanning switches $\mathbf{5}_1$–$\mathbf{5}_n$ are sequentially switched to the ground potential every horizontal scanning period. The light emission control circuit 4 generates a driving control signal (driving pulse) in accordance with pixel information indicated by image data to instruct which of EL elements connected to associated scanning lines are driven to emit light at which timing and for approximately how long, and supplies the drive control signal to the anode line drive circuit 2. The anode line drive circuit 2, responsive to this drive control signal, controls the switching of the drive switches $\mathbf{6}_1$–$\mathbf{6}_m$ to supply driving currents to associated EL elements through the anode lines $A_1$–$A_m$ in accordance with the pixel information. In this way, the EL elements supplied with the driving currents are forced to emit light in accordance with the pixel information.

There is a driver which is capable of displaying in gradation for representing the contrast of an image on the display panel using EL elements as described above. PWM (Pulse Width Modulation) is typically employed for gradation display. Specifically, the driver generates a pulse having a width in accordance with a specified gradation level determined by pixel information in a constant one-horizontal scanning period to activate a current source only for the duration of the pulse width to supply a driving current to EL elements to be lit. During the remaining period of the one-horizontal scanning period, the driver inactivates the current source to stop supplying the driving current from the current source.

However, the driver for conducting a gradation display has a problem of deteriorated linearity in the gradation display due to the fact that a current generated by the bias potential Vcc flows into EL elements through other EL elements on the same anode line to prevent the light emission from immediately stopping immediately after a transition from an active state from an inactive state of the current source within one horizontal scanning period.

Specifically, explaining one horizontal scanning period in which an EL element $E_{1,1}$ is driven to emit light from among EL element $E_{1,1}$–$E_{1,n}$ connected to an anode line $A_1$ of the driver illustrated in FIGS. 3 and 4, a driving current from a current source $\mathbf{2}_1$ flows into the ground through a drive switch $\mathbf{6}_1$, anode line $A_1$, EL element $E_{1,1}$, cathode line $B_1$, and scanning switch $\mathbf{5}_1$ during an activated period of the current source $\mathbf{2}_1$, causing the EL element $E_{1,1}$ to emit light, as illustrated in FIG. 5. In this event, the remaining EL elements $E_{1,2}$–$E_{1,n}$ connected to the anode line $A_1$ are applied with a substantially equal potential at both ends thereof, so that no current flows into the EL elements $E_{1,2}$–$E_{1,n}$. For example, when the bias potential Vcc is set at 20 V, the potential on the anode line $A_1$ is 20 V, so that the lighting EL element $E_{1,1}$ is applied with 20 V in the forward direction. At the time the current source $\mathbf{2}_1$ transitions from the active state to the inactive state, the EL element $E_{1,1}$ is discharged through light emission, resulting in a reduction in the voltage on the anode line $A_1$, as illustrated in FIG. 6. With the reduced voltage on the anode line $A_1$, a charging current to the EL elements $E_{1,2}$–$E_{1,n}$ is driven by the bias potential Vcc to flow into the ground through each of the EL elements $E_{1,2}$–$E_{1,n}$ anode line $A_1$, EL element $E_{1,1}$ cathode line $B_1$ and scanning switch $\mathbf{5}_1$ Thus, as illustrated in FIG. 6, the EL element $E_{1,1}$ is applied with a voltage higher than the light emission threshold voltage Vth in the forward direction, so that the EL element $E_{1,1}$ continues to emit light. On the other hand, since each of the EL elements $E_{1,2}$–$E_{1,n}$ is charged with a charging current of opposite polarity, the charging current level becomes lower as they are charged more. The voltage applied to the EL element $E_{1,1}$ in the forward direction, i.e., the potential on the anode line $A_1$ is also reduced with the passage of time as illustrated in FIG. 7, so that the light emission luminance of the EL element $E_{1,1}$ becomes gradually lower, and eventually, the light emission is stopped.

As a result, a linear relationship is not established between the pulse width generated corresponding to a specified gradation level and the brightness provided by light emitted by the EL element. Specifically, when a narrow pulse width is generated corresponding to a specified gradation level, actual light emission will result in an excessively bright display, failing to provide the brightness corresponding to the pulse width.

SUMMARY OF THE INVENTION

It is therefore an object of the present invention to provide an apparatus and method for driving a display panel which is capable of performing a proper gradation display corresponding to a gradation level defined by input video data.

The present invention provides an apparatus for driving a display panel having a plurality of drive lines and a plurality of scanning lines intersecting one another, and a plurality of capacitive light emitting elements having a polarity and connected between the scanning lines and the drive lines at a plurality of intersections of the drive lines with the scanning lines. The apparatus includes a controller for sequentially selecting one scanning line from the plurality of scanning lines every scanning period of input video data including a gradation level to specify a drive line corresponding to at least one capacitive light emitting element driven to emit light on the one scanning line in accordance with the input video data, a generator for generating a driving signal having a pulse width in accordance with the gradation level every scanning period, and a driver for applying the one capacitive light emitting element driven to emit light with a voltage equal to or higher than a light emission threshold voltage in a forward direction for a duration in which the driving signal is generated through the one scanning line and the drive line specified by the controller, wherein the driver applies the specified drive line with a predetermined potential in response to elimination of the driving signal to decrease the voltage applied to the one capacitive light emitting element driven to emit light in the forward direction to a voltage lower than the light emission threshold voltage.

The present invention also provides a method of driving a display panel having a plurality of drive lines and a plurality of scanning lines intersecting one another, and a plurality of capacitive light emitting elements having a polarity and connected between the scanning lines and the drive lines at a plurality of intersections of the drive lines with the scanning lines. The method includes the steps of sequentially selecting one scanning line from the plurality of scanning lines every scanning period of input video data including a gradation level to specify a drive line corresponding to at least one capacitive light emitting element driven to emit light on the one scanning line in accordance with the input video data, generating a driving signal having a pulse width in accordance with the gradation level every scanning period, applying the one capacitive light emitting element driven to emit light with a voltage equal to or higher than a light emission threshold voltage in a forward direction for a duration in which the driving signal is generated through the one scanning line and the specified drive line, and applying the specified drive line with a predetermined potential in response to elimination of the driving signal to decrease the voltage applied to the one capacitive light emitting element driven to emit light in the forward direction to a voltage lower than the light emission threshold voltage.

DETAILED DESCRIPTION OF THE PREFERRED EMBODIMENTS

In the following, one embodiment of the present invention will be described in detail with reference to the drawings.

Figure 9:
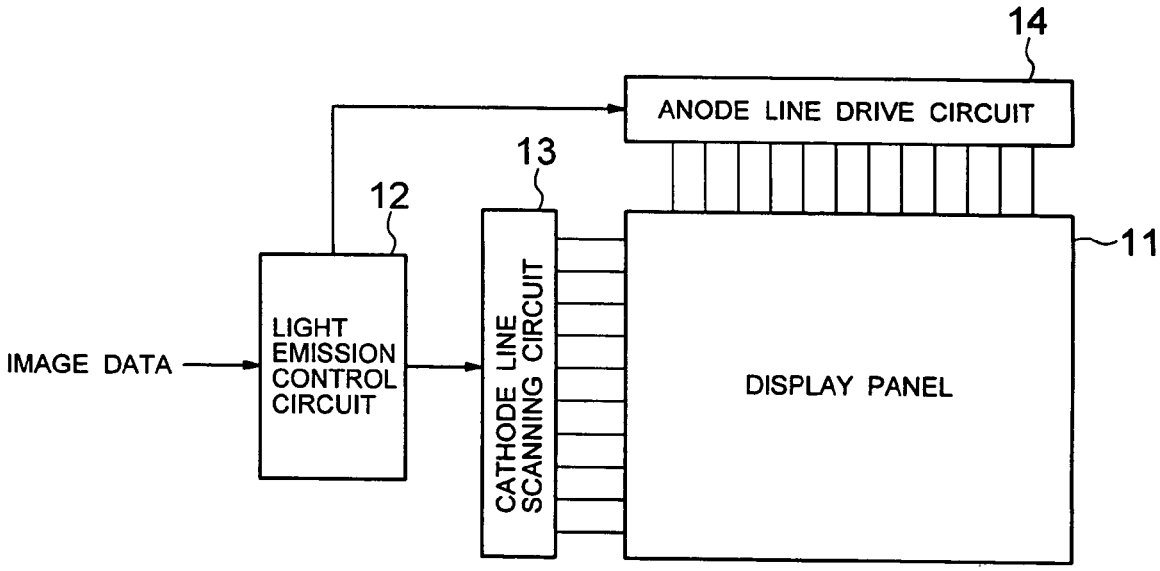
FIG. 9 is a block diagram illustrating the configuration of a display panel driver according to the present invention.

FIG. 9 illustrates the general configuration of a display device according to one embodiment of the present invention which employs organic electroluminescence elements as capacitive light emitting elements. The display device has a display panel 11; a light emission control circuit 12; a cathode line scanning circuit 13; and an anode line drive circuit 14.

Figure 1:
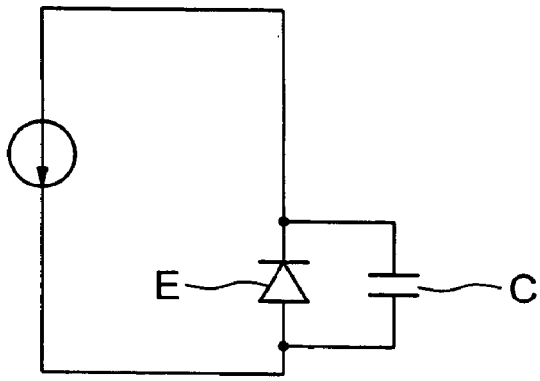
FIG. 1 is a diagram illustrating an equivalent circuit of an organic electroluminescence element.
Figure 2:
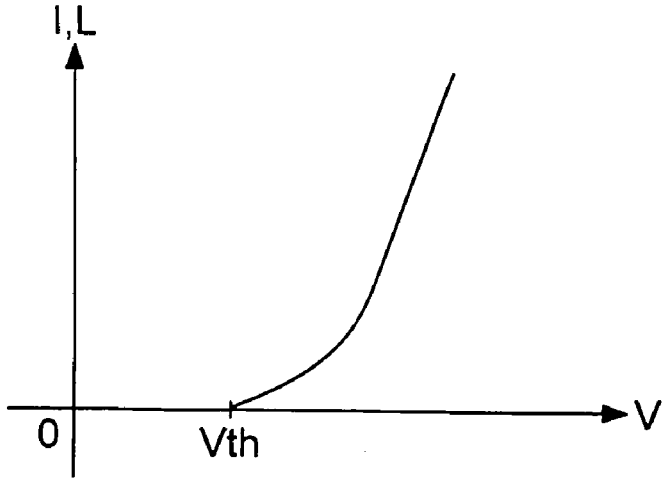
FIG. 2 is a diagram generally illustrating the driving voltage-current-emitted light luminance characteristic of the organic electroluminescence element.
Figure 3:
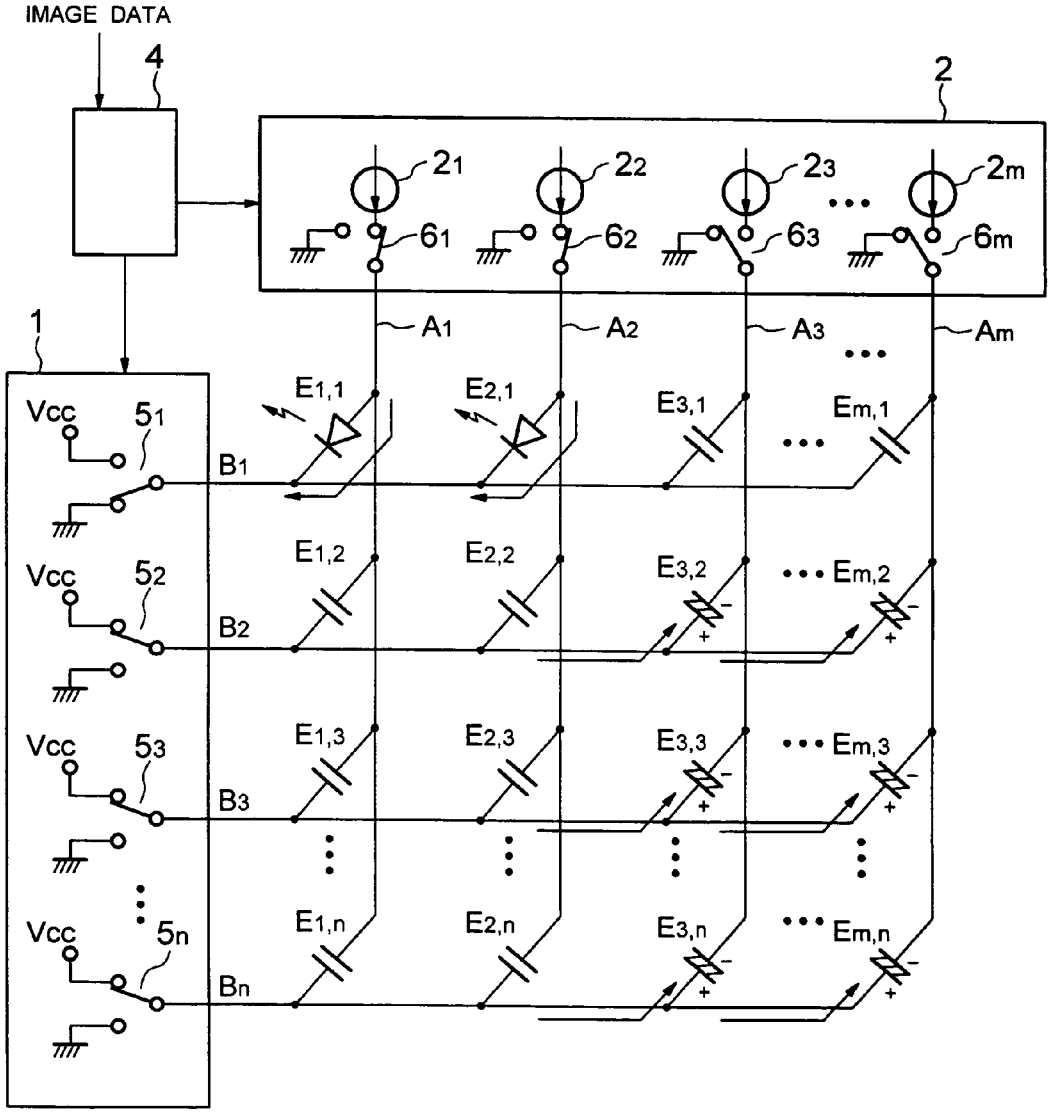
FIG. 3 Prior Art
FIGS. 3 and 4 are block diagrams for explaining the operation of a conventional driving apparatus.
Figure 4:
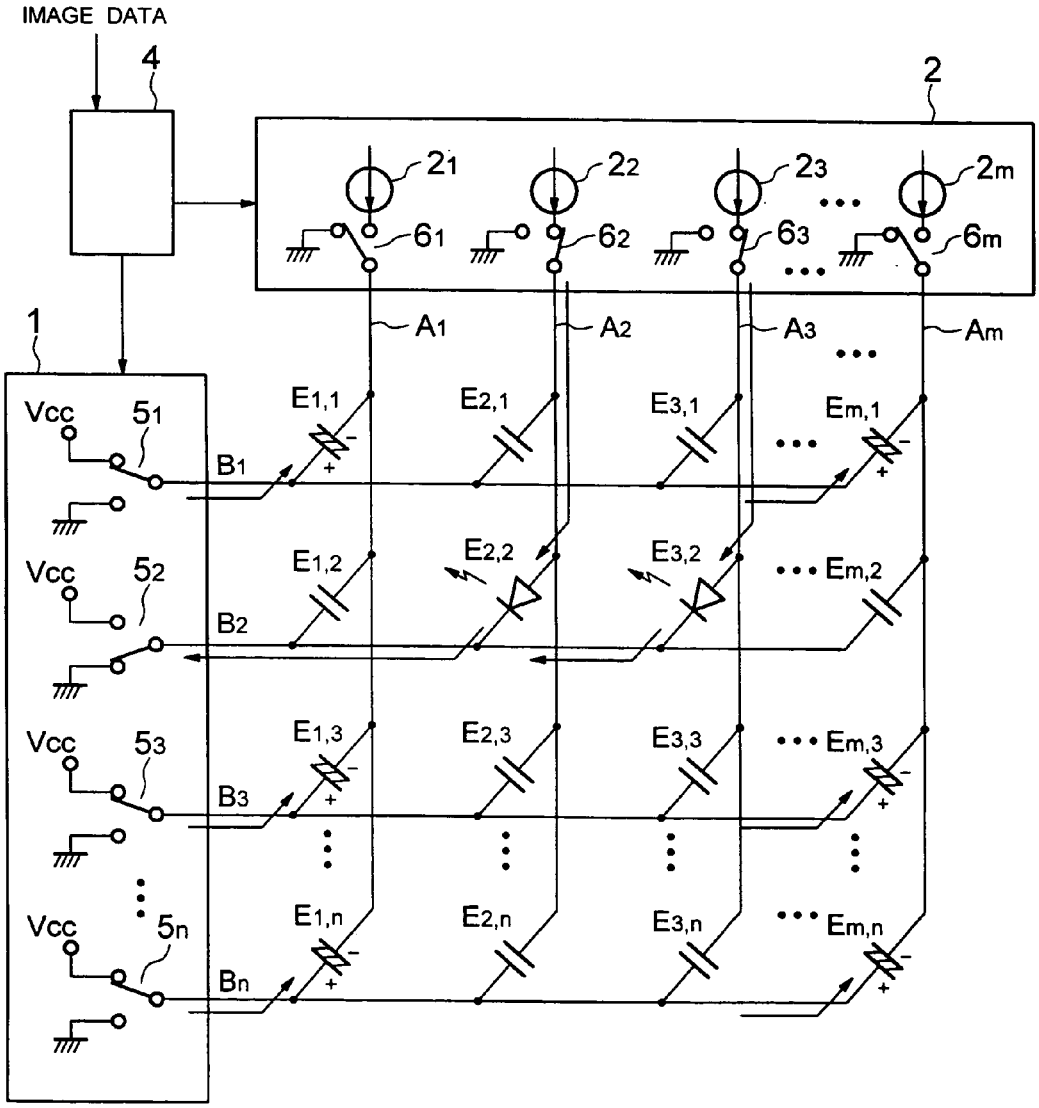
FIG. 4 Prior Art
Figure 5:
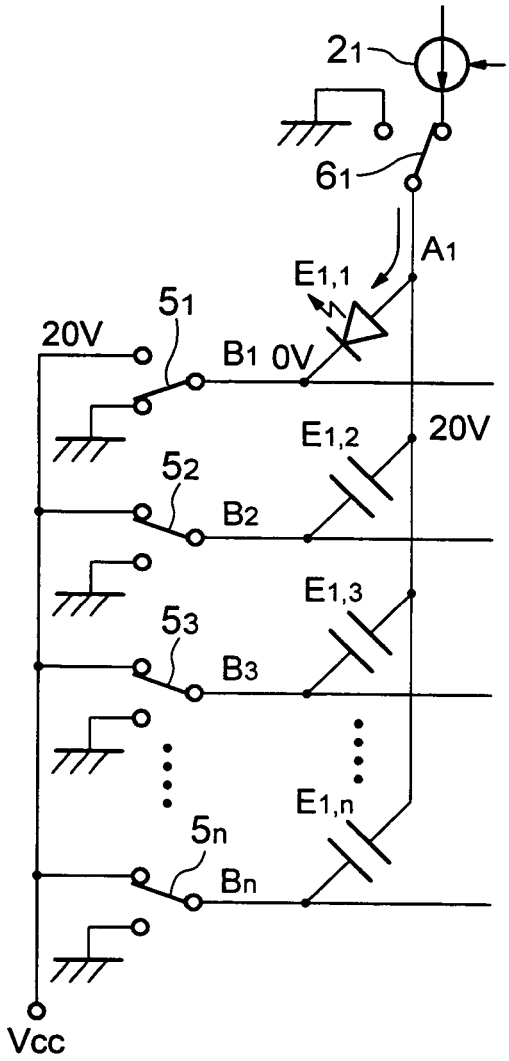
FIG. 5 Prior Art
FIG. 5 is a diagram illustrating the flow of a driving current in an active state of a current source in a conventional driver.
Figure 6:
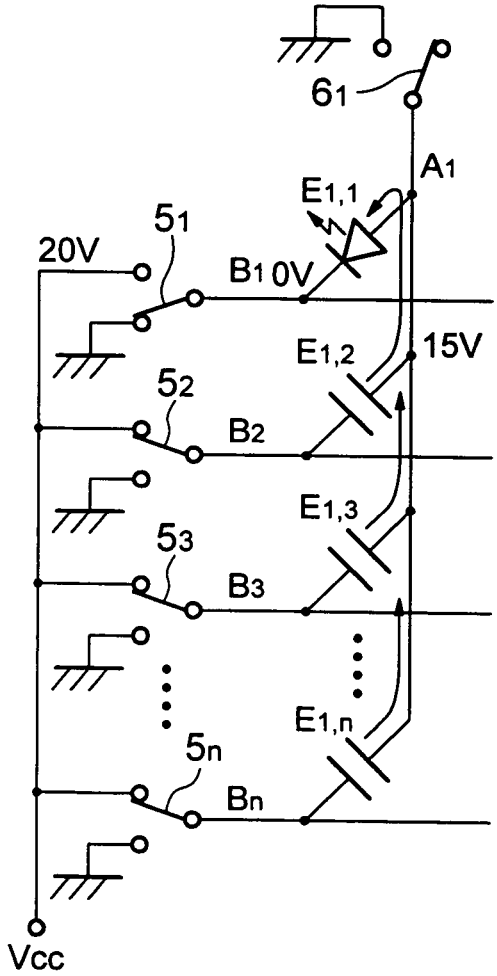
FIG. 6 Prior Art
FIG. 6 is a diagram illustrating the flow of a current immediately after the current source has transitioned from the active state to an inactive state in the conventional driver.
Figure 7:
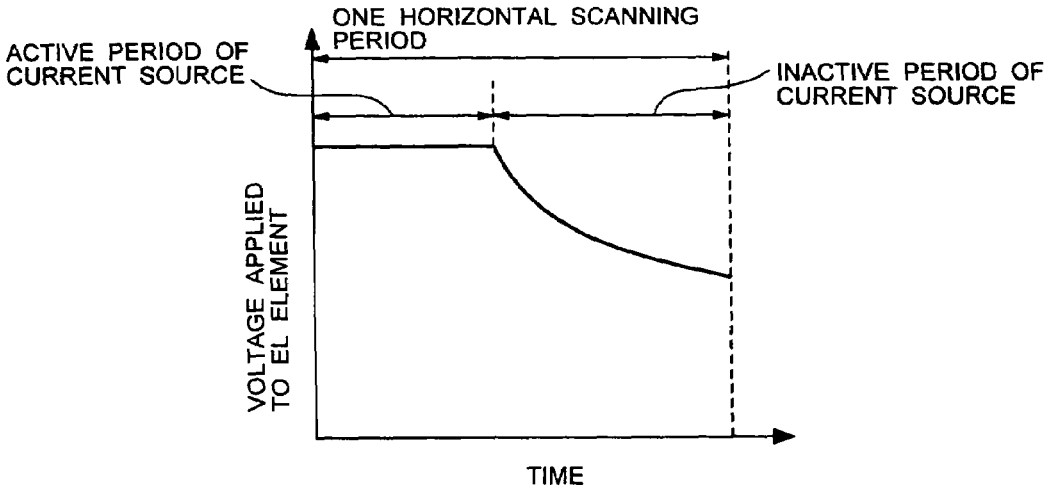
FIG. 7 is a diagram showing a change in a voltage applied to an EL element in one horizontal scanning period.
Figure 8:
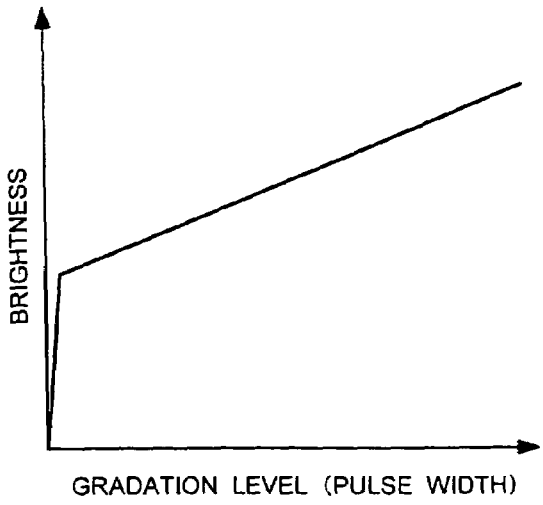
FIG. 8 is a graph showing the relationship between a gradation level and the brightness in a display panel.
Figure 10:
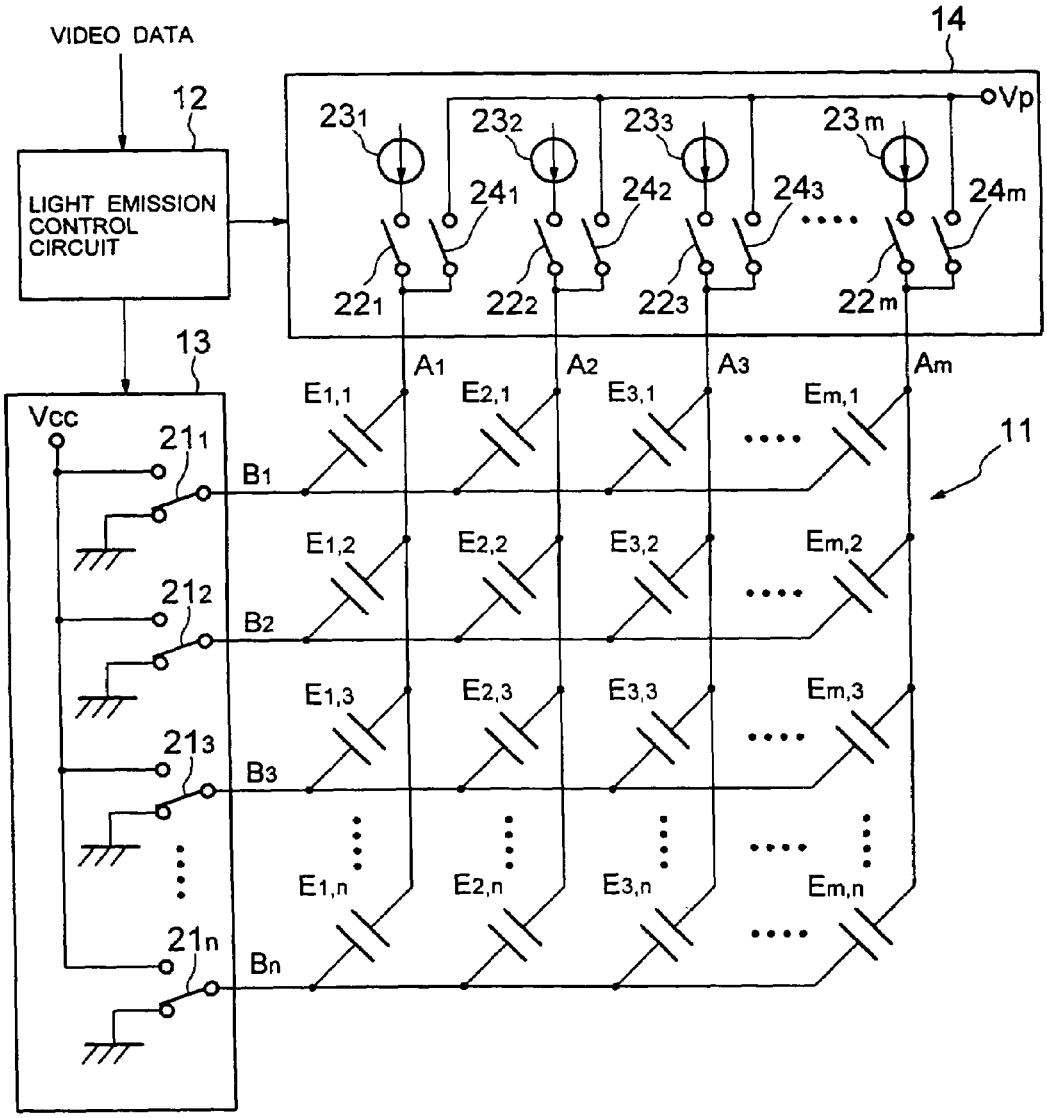
FIG. 10 is a diagram illustrating the configuration of a display panel, a cathode line scanning circuit, and an anode line drive circuit.

As illustrated in FIG. 10, the display panel 11 is configured in a manner similar to that illustrated in FIGS. 3 and 4. Specifically, a plurality of organic electroluminescence elements $E_{i,j}$ ($1 \leqq i \leqq m$, $1 \leqq j \leqq n$) are arranged in matrix at a plurality of intersections of anode lines $A_1$–$A_m$ functioning as drive lines with cathode lines $B_1$–$B_n$ functioning as scanning lines, and are each connected between associated anode line and cathode line at each of the plurality of intersections of the anode lines $A_1$–$A_m$ with the cathode lines $B_1$–$B_n$.

A cathode line scanning circuit 13 is connected to the cathode lines $B_1$–$B_n$ of the display panel 11, while an anode line drive circuit 14 is connected to the anode lines $A_1$–$A_m$. The cathode line scanning circuit 13 has scanning switches $\mathbf{21}_1$–$\mathbf{21}_n$ provided in correspondence to the cathode lines $B_1$–$B_n$, respectively. Each of the scanning switches $\mathbf{21}_1$–$\mathbf{21}_n$ supplies a corresponding cathode line with one of a ground potential and a bias potential Vcc. The bias potential Vcc is generated by a cathode power supply circuit, not shown, and is substantially equal to a predetermined light emission voltage at which an EL element can emit light.

Since the scanning switches $\mathbf{21}_1$–$\mathbf{21}_n$ are sequentially switched to the ground potential every horizontal scanning period, the cathode lines $B_1$–$B_n$ set at the ground potential function as scanning lines which enable elements connected thereto to emit light.

The anode line drive circuit 14 has first switches $\mathbf{22}_1$–$\mathbf{22}_m$, current sources $\mathbf{23}_1$–$\mathbf{23}_m$, and second switches $\mathbf{24}_1$–$\mathbf{24}_m$, which are provided corresponding to the respective anode lines $A_1$–$A_m$. Each of the first switches $\mathbf{22}_1$–$\mathbf{22}_m$ supplies a corresponding anode line with a current from the current source $\mathbf{23}_1$–$\mathbf{23}_m$. Each of the second switches $\mathbf{24}_1$–$\mathbf{24}_m$ supplies a corresponding anode line with a predetermined potential Vp. The predetermined potential Vp is generated by an anode power supply circuit, not shown, and is lower than a light emission threshold voltage Vth. In this embodiment, the predetermined potential Vp is 0 V equal to the ground potential.

The light emission control circuit 12 generates a PWM signal in accordance with pixel information indicated by image data to each of the anode lines $A_1$–$A_m$ for instructing which of EL elements connected to associated scanning lines are driven to emit light at which timing and for approximately how long, and supplies the drive control signal to the anode line drive circuit 14. The PWM signal is generated for anode lines connected to EL elements which should be driven to emit light in one horizontal scanning period for a duration in accordance with a gradation level.

The anode line drive circuit 14, responsive to the PWM signal, turns ON those of the first switches $\mathbf{22}_1$–$\mathbf{22}_m$ corresponding to light emission to electrically connect associated current sources with anode lines, thereby supplying associated EL elements with a driving current in accordance with pixel information from the current sources through the corresponding ones of the anode lines $A_1$–$A_m$ (specified driving liens), while supplying the remaining anode lines with the predetermined potential Vp through the second switches $\mathbf{24}_1$–$\mathbf{24}_m$.

Figure 11:
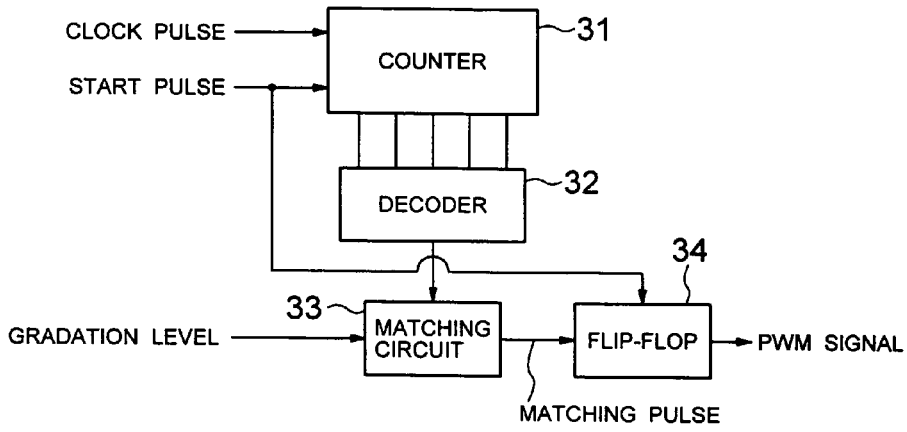
FIG. 11 is a block diagram illustrating the configuration of a PWM signal generator circuit in a light emission control circuit.
Figure 12:
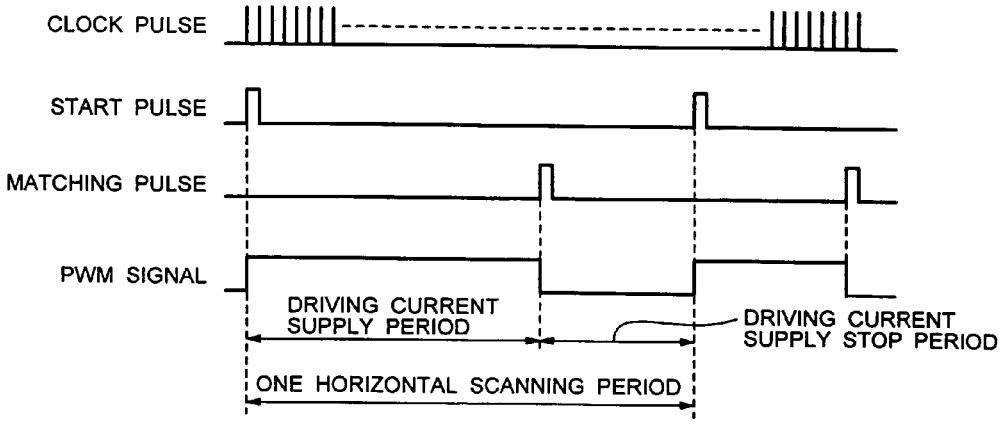
FIG. 12 is a waveform chart showing operation timing of the PWM signal generator circuit.

The PWM signal generator circuit in the light emission control circuit 12 is configured, for example, as illustrated in FIG. 11. Specifically, the PWM signal generator circuit comprises a counter 31; a decoder 32; a matching circuit 33; and a flip-flop 34. The counter 31 is supplied with a clock pulse and a start pulse, as illustrated in FIG. 12. The start pulse is a pulse indicating the start of one horizontal scanning period, and the counter 31 is reset in response to the rising of the start pulse and starts counting the clock pulse. A count value of the counter 31 has its sign converted by the decoder 32, and is supplied to the matching circuit 33. The matching circuit 33 is supplied with a gradation level indicated by pixel information, for example, as 8-bit data. The matching circuit 33 generates a matching pulse as illustrated in FIG. 12, when the count value of the counter 31 indicates that an output value of the decoder 32 is equal to the gradation level. The flip-flop 34 generates a pulse-shaped. PWM signal in response to the rising of the start pulse, as illustrated in FIG. 12, and stops generating the PWM signal in response to the rising of the matching pulse. For generating the PWM signal for 256 gradation levels, the counter 31 counts 255 clock pulses in one horizontal scanning-period. The PWM signal generator circuit is provided for each of the anode lines.

Figure 13:
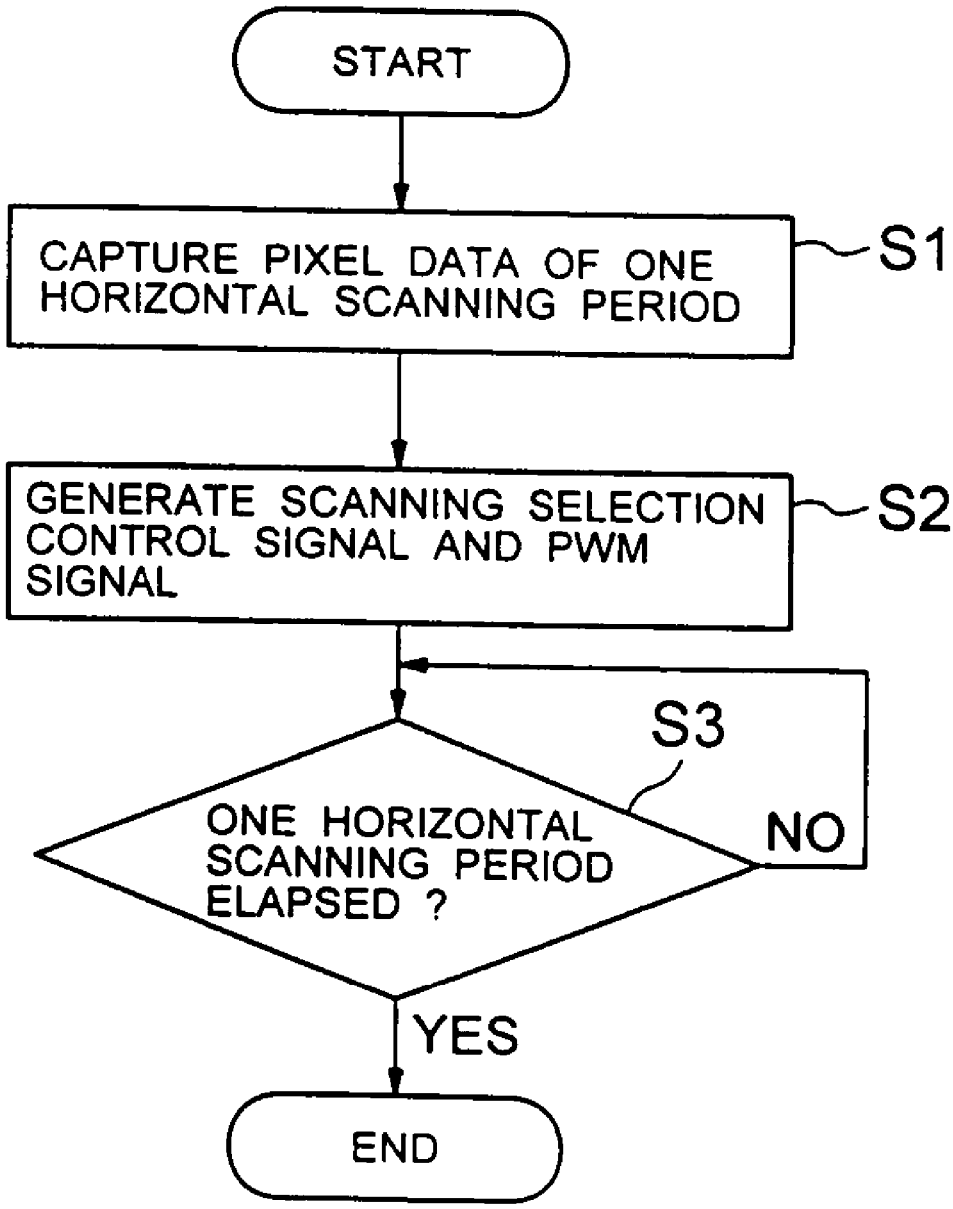
FIG. 13 is a flow chart illustrating a periodical operation of the light emission control circuit.

The light emission control circuit 12 executes a light emission control routine every horizontal scanning period of pixel data supplied thereto. As illustrated in FIG. 13, in the light emission control routine, the light emission control circuit 12 first captures pixel data of one horizontal scanning period (step S1), and generates a scanning selection control signal and a PWM signal in accordance with pixel information indicated by the pixel data of one horizontal scanning period (step S2). The PWM signal is generated corresponding to some of the anode lines A1–Am connected to EL elements which should be driven to emit light in the current horizontal scanning period.

The scanning selection control signal is supplied to the cathode line scanning circuit 13. The cathode line scanning circuit 13 switches one of the scanning switches (a scanning switch $\mathbf{21}_S$ within $\mathbf{21}_1$–$\mathbf{21}_m$, where S is an integer number in a range of 1 to n) associated with one of the cathode lines $B_1$–$B_m$ (one scanning line), corresponding to the current horizontal scanning period indicated by the scanning selection control signal, to the ground in order to set the one cathode line to the ground potential. The remaining scanning switches (all of the scanning switches $\mathbf{21}_1$–$\mathbf{21}_m$ except for the one scanning switch $\mathbf{21}_S$) are switched to the bias potential Vcc for applying the remaining cathode lines with the bias potential Vcc.

The PWM signal is supplied to a first switch (a corresponding first switch within $\mathbf{22}_1$–$\mathbf{22}_m$) and a second switch (a corresponding second switch within $\mathbf{24}_1$–$\mathbf{24}_m$) of the anode line drive circuit 14. The first switch supplied with the PWM signal is turned ON to electrically connect the current source with the anode line, while the first switches not supplied with the PWM signal is turned OFF. The second switch supplied with the PWM signal is turned OFF, while the second switches not supplied with the PWM signal is turned ON to supply the anode line with the predetermined potential Vp therethrough.

Figure 14:
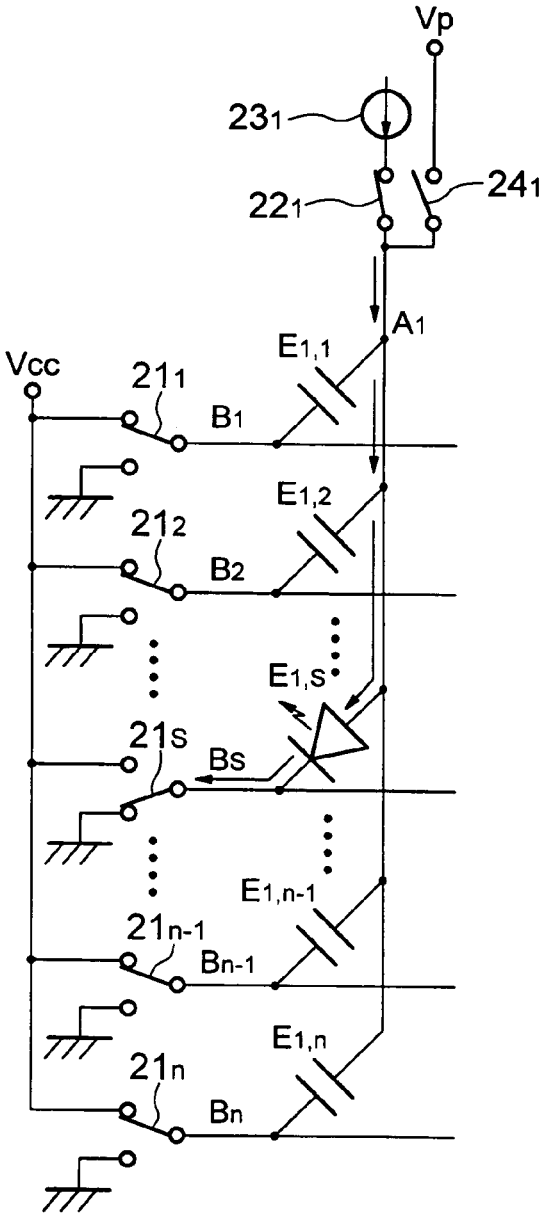
FIG. 14 is a diagram illustrating the flow of a driving current in a PWM signal generating period of the driver in FIG. 9.
Figure 15:
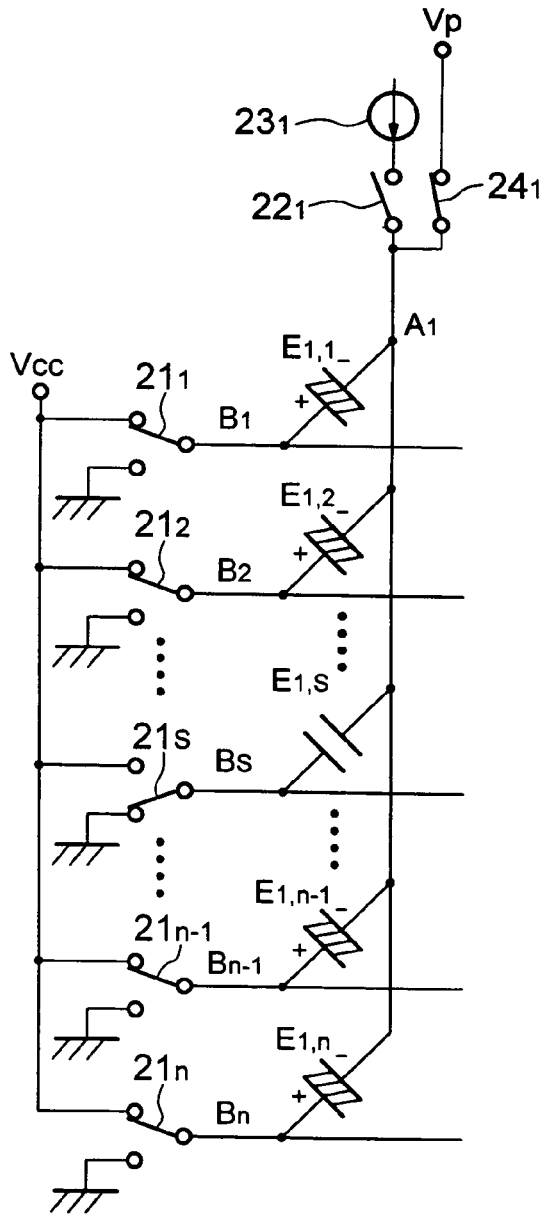
FIG. 15 is a diagram illustrating a voltage applied to each EL element in a PWM signal OFF period of the driver in FIG. 9.

Explaining now one horizontal scanning period in which the EL element $E_{1,1}$ is driven to emit light within the EL elements $E_{1,1}$–$E_{1,n}$ when the first switch $\mathbf{22}_1$ is turned ON and the second switch $\mathbf{24}_1$ is turned OFF in one horizontal scanning period as illustrated in FIG. 14, a driving current flows from the current source $\mathbf{23}_1$ to the first switch $\mathbf{22}_1$, anode line $A_1$, EL element $E_{1,S}$, cathode line $B_S$, scanning switch $\mathbf{21}_S$, and the ground, and is supplied to the EL element $E_{1,S}$ which is therefore driven to emit light. In this event, other EL elements connected to the anode line $A_1$ except for the EL element $E_{1,S}$ have substantially equal potentials across both ends thereof, so that no current will flow to other EL elements. For example, assuming that the bias potential Vcc is 20 V, the potential on the anode line $A_1$ is 20 V, and the light emitting EL element $E_{1,S}$ is applied with 20 V in the forward direction. Subsequently, as the light emission control circuit 12 stops generating the PWM signal to turn-the first switch $\mathbf{22}_1$ OFF and the second switch $\mathbf{24}_1$ ON as illustrated in FIG. 15, the anode of the EL element $E_{1,S}$ is applied with the predetermined potential Vp lower than the light emission threshold voltage Vth through the second switch $\mathbf{24}_1$. Thus, the EL element $E_{1,S}$ stops light emission since the voltage applied to the EL element $E_{1,S}$ in the forward direction is lower than the light emission threshold voltage Vth. The EL elements except for the EL element $E_{1,S}$ are applied with a voltage −Vp+Vcc, viewed from the anode side, so that they are charged again with the polarity as shown in FIG. 15. For example, assuming that the bias potential Vcc is 20 V and the predetermined voltage Vp is 0 V equal to the ground potential, as mentioned above, the EL element $E_{1,S}$ is applied with 0 V, while the EL elements connected to the anode line $A_1$ except for the EL element $E_{1,S}$ are applied with a reverse bias voltage −20V.

After execution of step S2, the light emission control circuit 12 determines whether or not one horizontal scanning period has elapsed (step S3). When one horizontal scanning period has elapsed, the light emission control circuit 12 transitions to the next one horizontal scanning period, repeating the operations at steps S1–S3.

Figure 16:
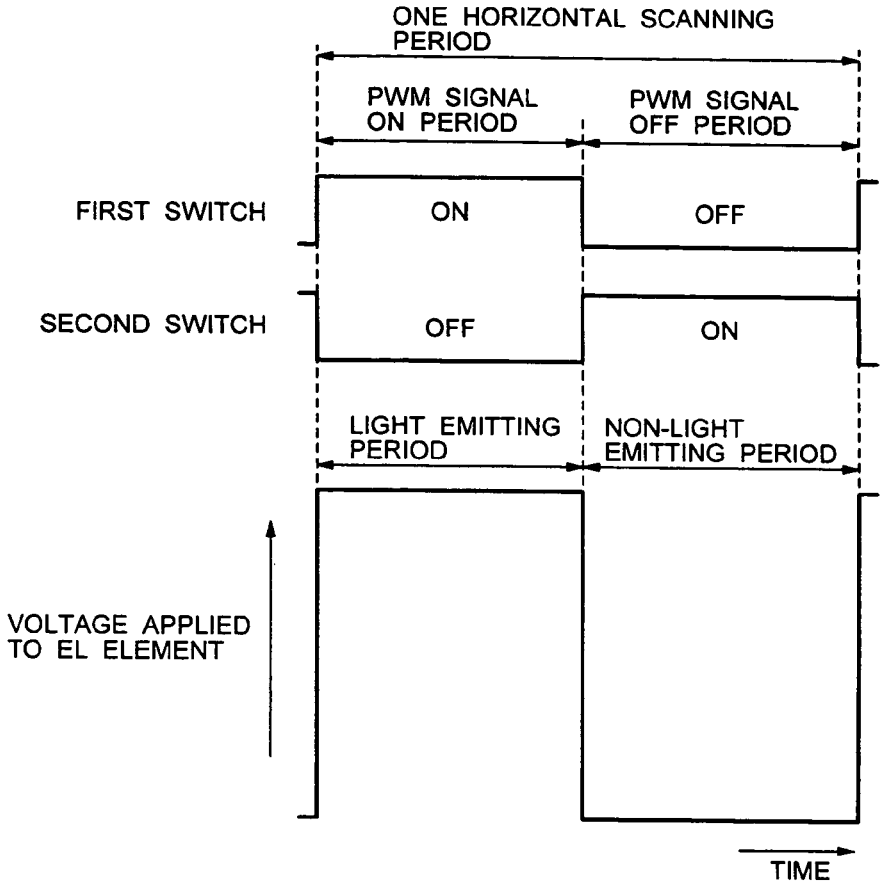
FIG. 16 is a diagram showing an ON/OFF switching operation of a first and a second switch and a change in a voltage applied to a light emitting EL element in one horizontal period.

As shown in FIG. 16, one horizontal scanning period consists of a PWM signal ON period in which the first switch is turned ON in the anode line drive circuit 14, and a PWM signal OFF period in which the second switch is turned ON. In the PWM signal ON period, EL elements which should be driven to emit light are applied with a voltage higher than the light emission threshold voltage Vth, for example, 20 V. With transition to the PWM signal OFF period, the EL elements are immediately applied with a voltage sufficiently lower than the light emission threshold voltage Vth, for example, 0 V.

Figure 17:
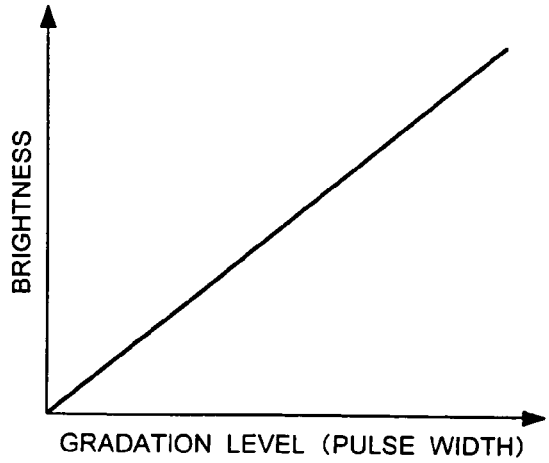
FIG. 17 is a graph showing the relationship between a gradation level and the brightness of a display panel in the driver in FIG. 9.
Figure 18:
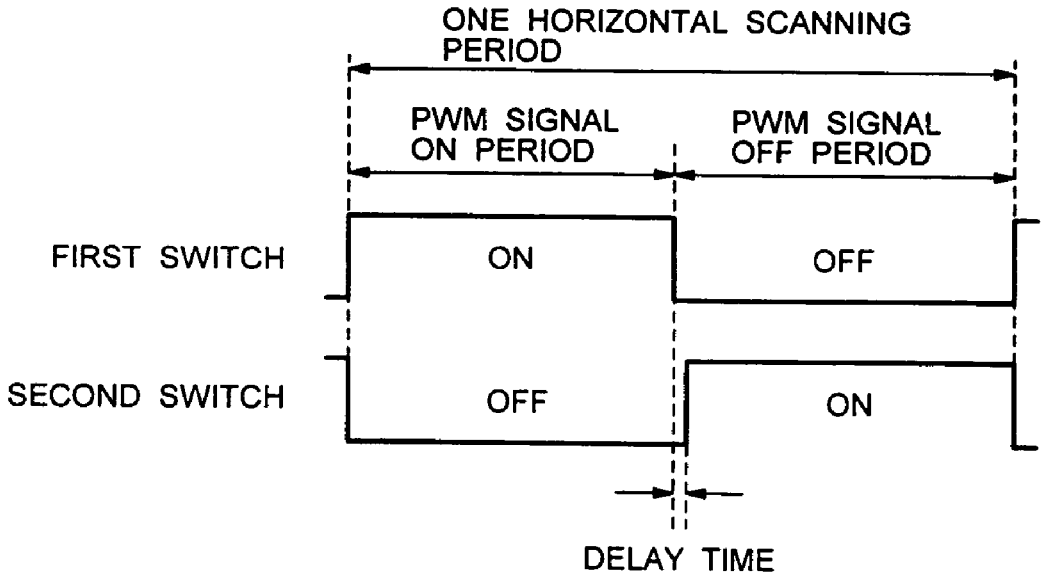
FIG. 18 is a diagram showing the ON/OFF switching operation of the first and second switches in one horizontal scanning period when a delay time is included in the switching operation.

As a result, a linear relationship is established between the pulse width generated corresponding to the specified gradation level and the brightness provided by light emitted by the EL element, as can be seen in FIG. 17.

Alternatively, in one horizontal scanning period, one horizontal scanning period may include a short delay time in which both the first and second switches are turned OFF between the PWM signal ON period in which the first switch in the anode line drive circuit 14 is turned ON and the PWM signal OFF period in which no PWM signal is generated to turn the second switch ON.

Also, while the foregoing embodiment uses the current sources $\mathbf{23}_1$–$\mathbf{23}_m$ as power supplies for the EL elements $E_{1,1}$–$E_{m,n}$, voltage sources may be used instead.

Further, while in the foregoing embodiment, a gradation level is set for each of the EL elements $E_{1,1}$–$E_{m,n}$ i.e., for each of pixels, the gradation level may be set for each of lines or each of screens.

As described above, according to the present invention, since a linear relationship is established between the pulse width generated corresponding to a gradation level for input video data and the brightness provided by light emitted by an EL element, a proper gradation display can be provided corresponding to the gradation level.

This application is based on Japanese Patent Application No. 2000-334596 which is hereby incorporated by reference.

What is claimed is:

1. An apparatus for driving a display panel having a plurality of drive lines and a plurality of scanning lines intersecting one another, and a plurality of capacitive light emitting elements having a polarity and connected between said scanning lines and said drive lines at a plurality of intersections of said drive lines with said scanning lines, said apparatus comprising:

a controller for sequentially selecting one scanning line from said plurality of scanning lines every scanning period of input video data including a gradation level to specify a drive line corresponding to at least one capacitive light emitting element driven to emit light on said one scanning line in accordance with said input video data;

a scanning circuit for applying the one scanning line with a first predetermined potential and applying the remaining scanning lines other than the one scanning line of said plurality of scanning lines with a second predetermined potential higher than the first predetermined potential, during the scanning period of the one scanning line; and a driver for generating a PWM (pulse width modulation) signal having a pulse width corresponding to said gradation level every scanning period and applying the PWM signal to the drive line specified by said controller, so that the at least one capacitive light emitting element is applied with a voltage equal to or higher than a light emission threshold voltage in a forward direction to emit light when the PWM signal is generated in the scanning period of the one scanning line, wherein said driver applies the specified drive line with a third predetermined potential which is higher than the first predetermined potential and which is lower than the second predetermined potential when the PWM signal is not generated in the scanning period of the one scanning line, so that the at least one capacitive light emitting element is applied with a voltage lower than the light emission threshold voltage in a forward direction not to emit light and capacitive light emitting elements other than the at least one capacitive light emitting element on the specified drive line are charged by being applied with a reverse bias voltage when the PWM signal is not generated in the scanning period of the one scanning line.

2. A driving apparatus according to claim 1, wherein said driver includes a current source for applying a voltage equal to or higher than said light emission threshold voltage in the forward direction to said one capacitive light emitting element driven to emit light.

3. A driving apparatus according to claim 1, wherein said driver includes a voltage source for applying a voltage equal to or higher than said light emission threshold voltage in the forward direction to said one capacitive light emitting element driven to emit light.

4. A driving apparatus according to claim 1, wherein said scanning circuit applies said one scanning line with a ground potential and applies said remaining scanning lines with a bias potential substantially equal to a predetermined light emission voltage, wherein the ground potential is used as said first predetermined potential.

5. A driving apparatus according to claim 1, wherein said capacitive light emitting elements are organic electroluminescence elements.

6. A method of driving a display panel having a plurality of drive lines and a plurality of scanning lines intersecting one another, and a plurality of capacitive light emitting elements having a polarity and connected between said scanning lines and said drive lines at a plurality of intersections of said drive lines with said scanning lines, said method comprising the steps of:

sequentially selecting one scanning line from said plurality of scanning lines every scanning period of input video data including a gradation level to specify a drive line corresponding to at least one capacitive light emitting element driven to emit light on said one scanning line in accordance with said input video data;

applying the one scanning line with a first predetermined potential and applying the remaining scanning lines other than the one scanning line of said plurality of scanning lines with a second predetermined potential higher than the first predetermined potential, during the scanning period of the one scanning line;

generating a PWM (pulse width modulation) signal having a pulse width corresponding to said gradation level every scanning period and applying the PWM signal to the specified drive line, so that the at least one capacitive light emitting element is applied with a voltage equal to or higher than a light emission threshold voltage in a forward direction to emit light when the PWM signal is generated in the scanning period of the one scanning line; and applying the specified drive line with a third predetermined potential which is higher than the first predetermined potential and which is lower than the second predetermined potential when the PWM signal is not generated in the scanning period of the one scanning line, so that the at least one capacitive light emitting element is applied with a voltage lower than the light emission threshold voltage in a forward direction not to emit light and capacitive light emitting element other than the at least one capacitive light emitting element on the specified drive line are charged by being applied with a reverse bias voltage when the PWM signal is not generated in the scanning period of the one scanning line.

* * * * *